US007232508B2

(12) United States Patent
Hosonuma

(10) Patent No.: US 7,232,508 B2
(45) Date of Patent: Jun. 19, 2007

(54) ELECTROLYTIC ELECTRODE AND PROCESS OF PRODUCING THE SAME

(75) Inventor: Masashi Hosonuma, Fujisawa (JP)

(73) Assignee: Permelec Electrode Ltd., Kanagawa (JP)

( * ) Notice: Subject to any disclaimer, the term of this patent is extended or adjusted under 35 U.S.C. 154(b) by 455 days.

(21) Appl. No.: 10/839,246

(22) Filed: May 6, 2004

(65) Prior Publication Data

US 2004/0226817 A1 Nov. 18, 2004

(30) Foreign Application Priority Data

May 15, 2003 (JP) ..... P. 2003-136832

(51) Int. Cl.
*C25B 11/10* (2006.01)

(52) U.S. Cl. ..... 204/290.12; 204/290.14; 204/290.01; 204/291; 204/292; 204/293; 427/77; 427/227; 427/247; 427/314; 427/318

(58) Field of Classification Search ..... 204/290.01, 204/290.12, 290.13, 291, 292, 293; 427/77, 427/227, 247, 314, 318
See application file for complete search history.

(56) References Cited

U.S. PATENT DOCUMENTS 3,711,385 A 1/1973 Beer et al.
4,039,400 A * 8/1977 Hayfield ..... 205/171
4,331,528 A 5/1982 Beer et al.
4,468,416 A 8/1984 Asano et al.
5,395,500 A 3/1995 Shimamune et al.

FOREIGN PATENT DOCUMENTS

EP 0 042 923 A2 1/1982
EP 1489200 A1 * 12/2004

OTHER PUBLICATIONS

European Search Report dated Apr. 4, 2006.

* cited by examiner

*Primary Examiner*—Bruce F. Bell
(74) *Attorney, Agent, or Firm*—Sughrue Mion, PLLC

(57) ABSTRACT

An electrolytic electrode having an interlayer having more excellent peeling resistance and corrosion resistance and longer electrolytic life than conventional electrolytic electrodes and capable of flowing a large amount of current at the industrial level and a process of producing the same are provided. The electrolytic electrode includes a valve metal or valve metal alloy electrode substrate on the surface of which is formed a high-temperature oxidation film by oxidation, and which is coated with an electrode catalyst. The high-temperature oxidation film is integrated with the electrode substrate, whereby peeling resistance is enhanced. Further, by heating the high-temperature oxidation film together with the electrode catalyst, non-electron conductivity of the interlayer is modified, thereby making it possible to flow a large amount of current.

11 Claims, 2 Drawing Sheets

ELECTROLYTIC ELECTRODE AND PROCESS OF PRODUCING THE SAME

FIELD OF THE INVENTION

The present invention relates to an electrolytic electrode that is used in various industrial electrolyses, and a process of producing the same. In more detail, the present invention relates to an anode for generating oxygen, which is used in the industrial electrolysis for electrolytic copper foil manufacture, aluminum in-liquid power feed, and continuous electrolytic zinc-coated carbon steel sheet manufacture, and the like, and a process of producing the same.

DESCRIPTION OF THE RELATED ART

In recent years, in the industrial electrolysis for electrolytic copper foil manufacture, aluminum in-liquid power feed, and continuous electrolytic zinc-coated carbon steel sheet manufacture, and the like, anodes composed mainly of a metallic titanium substrate coated with iridium oxide as an electrode catalyst have been frequently employed. However, since anodes for generating chlorine, which are used in the electrolysis of salt and composed mainly of ruthenium oxide as an electrode catalyst, have a direct bearing on the purity of chlorine and sodium hydroxide products, the management of an electrolytic bath is exhaustive, and it is rare that impurities likely hastening consumption of the electrode catalyst mingle into the electrolytic bath. On the other hand, in the industrial electrolysis for producing a product with added value mainly in a cathode, organic materials or impurity elements are added for the purpose of stabilizing the product. For this reason, in the vicinity of the anode where the generation of oxygen is performed in the diaphragm-free state, various electrochemical reactions or chemical reactions occur, thereby further hastening the consumption of the electrode catalyst due to an increase of the hydrogen ion concentration (a lowering of pH) following the generation reaction of oxygen.

The ruthenium oxide electrode catalyst that is usually used for the generation of chlorine can be used to and extent of about 90% of the catalyst-supporting amount. On the other hand, the iridium oxide electrode catalyst that is frequently used for the generation of oxygen can be used to an extent of only about 50%, and the electrode potential increases in that state, whereby the electrolysis may often become impossible.

The potential increase of the electrode for generating oxygen is started from the consumption of the electrode catalyst and corrosion of the electrode substrate generated due to the common cause. Further, it is considered that because of partial internal consumption and peeling of the electrode catalyst, current convergence to the residual electrode catalyst is added, whereby the potential increase advances in the chained and accelerated way.

To suppress corrosive dissolution of the electrode substrate and accompany peeling of the effective electrode catalyst from the electrode catalyst, there are employed a lot of methods represented by a method of providing an interlayer (high-temperature oxidation film) between a titanium substrate and an electrode catalyst layer.

In general, as the interlayer, those having an electrode activity lower than the electrode catalyst layer are chosen, and any of these types have electron conductivity and have a role such that by making the electrode substrate far from a corrosive electrolyte and an oxygen-generating side resulting in a lowering of pH, the damage of the substrate is relieved.

As the interlayer that can meet these requirements, JP-B-60-21232 proposes an interlayer in which an oxide of tantalum and/or niobium is provided in a thickness of 0.001–1 g/m$^2$ as reduced into a metal, and electroconductivity is imparted to a titanium oxide film formed on the substrate surface. Further, JP-B-60-22074 proposes a valency-controlled semiconductor comprising an oxide of titanium and/or tin having an oxide of tantalum and/or niobium added thereto. Both of them are widely used on an industrial scale. However, in recent years, in view of the trend of attaching importance to the economical efficiency, the operation condition becomes severe more or more, and electrodes having higher durability are required.

As a simple and practically useful measure, there is the case of increasing the coating amount of the electrode catalyst. However, it is not always the case that the coating amount is in direct proportion to the electrode life. In the severe circumstance as described previously, since deterioration also advances in the vicinity of the interface between the electrode substrate and the electrode catalyst, all of the increased electrode catalyst is not always effectively utilized. As a result, the precious electrode catalyst will be wasted.

To overcome the problems in forming such an interlayer, a method in which a titanium-made electrode substrate itself is electrolytically oxidized to convert titanium on the surface of the electrode substrate to titanium oxide, thereby forming an interlayer (titanium oxide single layer) is described in JP-A-7-90665. However, in the electrode described in this publication, since the interlayer that can be formed by electrolytic oxidation is extremely thin, sufficient corrosion resistance is not obtained. For this reason, a thick titanium oxide second single layer is formed on the surface of the foregoing first titanium oxide single layer by the thermal decomposition method, on which is then formed an electrode catalyst layer. Incidentally, though it is also disclosed to form the first titanium oxide single layer upon heating in an oxygen-containing atmosphere, even in this case, the second titanium oxide single layer is formed.

According to the method described in JP-A-7-90665, since the formation of an interlayer requires two steps, especially steps requiring equipment quite different from each other as in electrolysis and thermal decomposition, the workability is inferior, and economical loads are large. Therefore, this method could not have sufficient practical usefulness.

SUMMARY OF THE INVENTION

The present invention has been made in view of the above disadvantages of the conventional techniques.

Accordingly, one object of the present invention is to provide an electrolytic electrode in which an interlayer (high-temperature oxidation film) that is rich in corrosion resistance, is minute, can be firmly welded to an electrode substrate and can be prepared in a single step is formed midway between an electrode substrate and an electrode catalyst.

Another object of the present invention is to provide processes of producing the electrolytic electrode.

The electrolytic electrode according to the present invention comprises:

a valve metal or valve metal alloy electrode substrate, a high-temperature oxidation film formed on the surface of the valve metal or valve metal alloy electrode by high-temperature oxidation treatment such that an increase of weight is 0.5 $g/m^2$ or more, and an electrode catalyst layer formed on the surface of the high-temperature oxidation film.

A process of producing an electrolytic electrode according to a first embodiment of the present invention comprises:

forming a high-temperature oxidation film on the surface of a valve metal or valve metal alloy electrode by high-temperature oxidation treatment such that its increase of weight is 0.5 $g/m^2$ or more (1.25 $g/m^2$ or more as reduced into $TiO_2$), and forming an electrode catalyst layer on the high-temperature oxidation film.

A process of producing an electrolytic electrode according to a second embodiment of the present invention comprises:

forming a high-temperature oxidation film on the surface of a valve metal or valve metal alloy electrode by high-temperature oxidation treatment, and forming an electrode catalyst layer on the high-temperature oxidation film, wherein in forming the high-temperature oxidation film, an increase of weight of the high-temperature oxidation film is at least an increase of weight of a high-temperature oxidation film of a valve metal or valve metal alloy electrode substrate formed at a heating temperature of 600° C. for a holding time of one hour in air.

1: Electrode substrate

2: Interlayer

3: Electrode catalyst layer

DETAILED DESCRIPTION OF THE INVENTION

Figure 1:
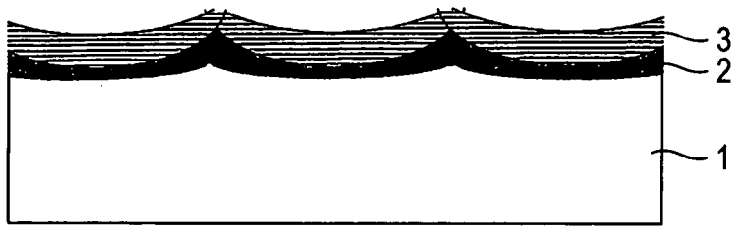
FIG. 1 is a conceptional view showing one embodiment of an electrolytic electrode according to the present invention.

The present invention will be described below in detail.

Different from the conventional techniques, according to the present invention, a high-temperature oxidation film comprising an oxide of a valve metal or valve metal alloy is formed on the surface of a valve metal or valve metal alloy electrode substrate (hereinafter referred to "valve metal substrate" or "electrode substrate"), the high-temperature oxidation film functioning as an interlayer between the valve metal substrate and an electrode catalyst layer described later, in a single step of only high-temperature oxidation in a substantially oxidative atmosphere.

A high-temperature oxidation film of an electrode substrate obtained by high-temperature oxidation is rich in corrosion resistance, is minute and is firmly welded to the electrode substrate. Accordingly, the high-temperature oxidation film should protect the electrode substrate and be further able to surely support an electrode catalyst composed mainly of an oxide by means of oxide-oxide linkage. However, actually, the high-temperature oxidation film had a defect that it is inferior in electron conductivity. And when its thickness is increased, this defect became more remarkable.

The present inventor has solved the above problems by finding that by baking an electrode catalyst layer on this high-temperature oxidation film by the coating thermal decomposition method, even in the high-temperature oxidation film in a region where though an effect for protecting the electrode substrate is large, the electron conductivity is inferior (the increase of weight is 0.5 $g/m^2$ or more; 1.25 $g/m^2$ or more as reduced into $TiO_2$), the electron conductivity increases consequently, whereby a large amount of current at the industrial level can be flown. When the increase of weight is 0.67 $g/m^2$ or more (1.68 $g/m^2$ or more as reduced into $TiO_2$), the effect is especially remarkable, and its upper limit is 17 $g/m^2$ (about 42 $g/m^2$ as reduced in $TiO_2$). When the increase of weight exceeds this upper limit, the film thickness is 10 μm or more, the oxidation film turns in color from gray to white, and adhesion between the oxidation film and the electrode substrate is deteriorated.

That is, the thus formed high-temperature oxidation film is an oxide and is usually inferior in electron conductivity. When after forming the high-temperature oxidation film, it is heat treated at a high temperature of 300° C. or higher, the electron conductivity can be modified, thereby making it possible to flow a large amount of current at the industrial level. This heat treatment is performed separately from the heat treatment at the time of forming a high-temperature oxidation film and can be carried out simultaneously with or before or after the formation of an electrode catalyst layer. The modification simultaneously with the formation of an electrode catalyst layer means that in the formation of an electrode catalyst layer accompanied with heating as in the coating thermal decomposition method, modification of the high-temperature oxidation film occurs due to the heating at the same time of the formation of an electrode catalyst layer.

Since the thus formed high-temperature oxidation film (interlayer) is integrated with the electrode substrate, it is never peeled away from the electrode substrate. Further, this high-temperature oxidation film is minute and rich in corrosion resistance. Accordingly, the high-temperature oxidation film sufficiently protects the electrode substrate and is formed as an oxidation film. Thus, the high-temperature oxidation film makes it possible to more surely support the electrode catalyst constituted mainly of an oxide on the electrode substrate by means of oxide-oxide linkage.

In the present invention, as the substrate material, though titanium and titanium alloys can be preferably used, so-called valve metals such as tantalum, niobium, and zirconium and alloys thereof can also be used because modification of a valve metal oxidation film can be achieved. The reason why titanium and titanium alloys are preferable resides in not only their corrosion resistance and economy but also the matter that they are large in a ratio of strength to specific gravity, i.e., a specific strength and relatively easy in processing such as rolling, and processing technologies such as cutting are very improved in recent years. The shape of the substrate material may be in a simple shape such as the rod-like shape and plate-like shape or may have a complicated shape by means of mechanical processing, and the surface may be either smooth or porous. The surface as referred to herein means a portion that when dipped in an electrolyte, can come into contact therewith.

Since stains on the substrate surface, such as oils and fats, cutting wastes, and salts adversely affect the properties of the high-temperature oxidation film, it is desired that they are previously cleaned and removed as far as possible.

Examples of cleaning that can be employed include alkaline washing, ultrasonic cleaning, steam cleaning, and scrubbing cleaning.

By roughing the surface by blasting or etching to enlarge the surface area, the welding strength is enhanced so that the electrolytic current density can be substantially reduced. By carrying out etching, cleanliness of the surface increases as compared with mere surface cleaning. In the case of blasting, it is very preferred to perform etching for the purpose of removing blast particles stuck on the surface. The etching is carried out using a non-oxidative acid such as hydrochloric acid, sulfuric acid, and oxalic acid or a mixed acid thereof at the boiling point thereof or at a temperature closed to the boiling point, or using nitric-hydrofluoric acid in the vicinity of room temperature.

As finishing, after rinsing the surface with pure water, the surface is sufficiently dried. It is also possible to rinse the surface with a large amount of tap water before using pure water.

The electrode substrate is subjected to high-temperature oxidation treatment to form a high-temperature oxidation film on the surface of the electrode substrate.

Basically speaking, the method of forming a high-temperature oxidation film, which is carried out in the present invention, is not largely different from annealing to be carried out in air.

As a heating system of a heat treatment furnace, systems of atmospheric (convective) heating, direct heating using a nichrome wire or kanthal wire, an infrared ray lamp, a far infrared ray panel, a radiant tube, etc., conductive heating using a hot plate, etc., and electromagnetic induction heating are all employable. For example, the heat conductivity of pure titanium at 600° C. is small as about one-half of that of pure iron. Accordingly, in order to obtain a uniform temperature distribution as far as possible, a heating system having many convective heating elements is preferable. The atmosphere may be oxidative, and in addition to air, oxygen, water vapor, carbon dioxide, and combustion gases such as town gas, gases in which ozone gas is mixed in an inexpensive carrier gas can be employed. When hydrogen gas or an ammonia decomposition gas containing hydrogen gas is mixed, titanium or an titanium alloy is hydrogenated, thereby embrittling even the deepest part, and therefore, it is desired to avoid such usage. Needless to say, an inert gas such as argon or a vacuum is not effective and improper.

The substrate having been formed into a prescribed shape and subjected to pre-treatment such as cleaning is inserted in a furnace while hanging by a hanger or placing on a rack. In all of the cases, attention must be paid such that a plurality of substrates do not come into intimate contact with each other, but renewal of a substrate to be brought into contact with the substrate is carried out without delay. When the feed of an oxidative gas becomes rate-determining, the growth of the oxidation film in the vicinity of the center of the surfaces of the superimposed substrates is delayed, and therefore, such is not preferable.

The substrate may be inserted into the furnace after raising the temperature of the furnace to a prescribed temperature. However, in order to obtain a uniform temperature distribution, it is desired that the substrate is inserted at a temperature as low as possible, followed by raising the temperature.

After arrival at a prescribed temperature, to obtain a high-temperature oxidation film having a fixed thickness, the temperature is held for a prescribed period of time and then reduced.

The high-temperature oxidation film of titanium observed in the present invention usually has a thickness of 0.1 μm or more. Examples of a method of evaluating the thickness at this level include measurement of an increase of weight, cross section observation by SEM, SIMS, GDS, X-ray diffraction, electron beam diffraction, and ellipsometry. Though each of these methods has merits and demerits, the measurement of an increase of weight is simple and suitable.

The form of the high-temperature oxidation film interlayer will be described below while focusing the increase of weight that should be an index.

In the present invention, for example, in the case of a rectangular parallelepiped with three sides a, b and c, a value of the surface area expressed by a unit such as $mm^2$, $cm^2$, and $m^2$ means $(a\times b+b\times c+c\times a)\times 2$. So to speak, this value is a surface area corresponding to the shape of the substrate, and in meshes or punching metals, it is approximated by a three-dimensional shape model divided into a polyhedron, a cylinder, etc. Further, it is to be distinguished from a specific surface area by the BET method as calculated from the gas adsorption amount of a single molecular layer.

When an increase of weight by means of high-temperature oxidation is defined as $\Delta W$ ($g/m^2$), and O and Ti are defined as 16.00 and 47.88, respectively, the weight $W_{TiO2}$ ($g/m^2$) of a high-temperature oxidation film of titanium is calculated as follows.

$$W_{TiO2}=\Delta W/(16.00\times 2)\times(47.88+16.00\times 2)$$

Further, since only $TiO_2$ of a rutile phase is detected from identification of a crystal phase by the X-ray diffraction of the high-temperature oxidation film of titanium, when the density of $TiO_2$ of the rutile phase is defined as 4.27 g/ml, the thickness t (μm) is calculated as follows.

$$t=W/(16.00\times 2)\times(47,88+16.00\times 2)/100^2/4.27\times 10000$$

The larger the surface roughness of the substrate, the larger the actual surface area is, and thus, the increase of weight becomes large. Accordingly, the reduced value into the thickness is calculated thicker; when the oxidation film becomes oxygen deficient as compared with the proportioning formulation of $TiO_2$, the thickness is calculated thinner; and when oxygen is dissolved in metallic titanium of the substrate, the thickness is calculated thinner. Actually, influences of the surface roughness of the substrate are largest, and the thickness is liable to be calculated thicker as compared with the measured value by cross section observation.

Also, titanium alloys are generally suppressed with respect to the growth of a high-temperature oxidation film as compared with pure titanium.

Since the convex part of the actual surface roughness by the cross section observation is large in an area where it receives heat radiations or comes into contact with gas, the oxidation film grows thick. On the other hand, since the concave part is inversely small in an area where it receives heat radiations or comes into contact with gas, the oxidation film is thin. A specular titanium substrate that is smooth and free from roughness is never used as the actual industrial electrolytic substrate. Further, the thickness of the high-temperature oxidation film largely varies depending upon unevenness or shape of the surface. Accordingly, it is not proper to define the thickness as a quantitative evaluation method of the high-temperature oxidation film.

For example, according to the measured values on a cross section SEM photograph when a high-temperature oxidation film was formed using a titanium substrate having a surface roughness Ra of 12.5 μm in air at a heating temperature of 600° C. for a holding time of one hour, the thickness of a thick portion of the convex part generally reached 0.5–0.7 μm, and the thickness of a thinnest portion of the concave part was merely about 0.1 μm. Incidentally, at this time, the measured value of the increase of weight was 0.67 $g/m^2$ (0.067 $mg/cm^2$), and the increase of weight as reduced into $TiO_2$ according to the foregoing calculation express was 1.67 $g/m^2$, and the thickness as reduced into rutile type $TiO_2$ was 0.39 μm.

With respect to the increase of weight of a high-temperature oxidation film of pure titanium in air, some literature documents are known. In one of them, from a rate constant $Kp=33.46\times10^{-4}$ (40 hours or shorter) of high-temperature oxidation of pure titanium in air at 600° C., an increase of weight of a high-temperature oxidation film at 600° C. for one hour is calculated to be 0.058 $mg/cm^2$ (A. M. Chaze and C. Coddet, *Oxidation of Metals*, Vol. 27, Nos. 1/2, 1–20 (1987)).

The increase of weight of 0.67 $g/m^2$ (0.067 $mg/cm^2$) of the high-temperature oxidation film of the titanium substrate formed at a heating temperature of 600° C. for a holding time of one hour in air is slightly larger than that described in this literature document. This is because the substrate having a non-smooth surface and having a surface roughness closed to a substrate to be provided for industrial electrolysis is used. Accordingly, in the present invention, the increase of weight of the high-temperature oxidation film interlayer that is essentially effective was defined to be 0.50 $g/m^2$ (0.050 $mg/cm^2$) or more. At this time, the weight as reduced into $TiO_2$ is 1.25 $g/m^2$, and the thickness as reduced into rutile type $TiO_2$ is 0.29 μm. A lower limit of the increase of weight may be defined to be 0.67 $g/m^2$ that is the actual increase of weight.

An electrode catalyst layer containing a platinum group metal or platinum group metal oxide as the major catalyst is subsequently provided on the thus formed high-temperature oxidation film. The platinum group metal or platinum group metal oxide is properly chosen singly or in combination among platinum, ruthenium oxide, iridium oxide, rhodium oxide, palladium oxide, and the like corresponding to a variety of electrolyses. To enhance the adhesion to the substrate or durability against electrolysis, it is desired to mix titanium oxide, tantalum oxide, tin oxide, etc.

As the coating method of this electrode catalyst layer, the coating thermal decomposition method, the sol-gel method, the paste method, the electrophoresis method, the CVD method, and the PVD method, etc. can be employed. Especially, the coating thermal decomposition method described in JP-B-48-3954 and JP-B-46-21888 is suitable.

The reason why when heat treatment is carried out simultaneously with or before or after the formation of an electrode catalyst layer of the electrolytic electrode of the present invention, the electron conductivity of the high-temperature oxidation film that is inferior in electron conductivity increases is not always theoretically clear, it may be assumed based on some proper estimations as follows.

In general, when adjacent two phases are in the equilibrium state, a principle that the chemical potential of the respective components is identical in all of the phases. That is, when the two adjacent phases containing oxygen are in the equilibrium state at the interface, the chemical potential of oxygen should be continued at the interface of the two phases. In order that the whole of the two phases achieves the equilibrium, diffusion of oxygen over a long distance is necessary. However, it is said that in order to achieve local equilibrium at the interface, diffusion of only about several angstroms may be required (Paul G Shewmon, *Diffusion in Solids*, translated by Kazuo Fueki and Koichi Kitazawa and published by Corona Publishing Co., Ltd., p. 148 (1976)).

It is considered that with respect to the oxygen concentration profile of the high-temperature oxidation film of titanium and titanium alloy in the depth direction, in view of the mechanism that oxygen is diffused from the substrate surface to the inside of the substrate, the oxygen concentration is naturally highest in the outermost surface layer, and in the outermost surface layer of the high-temperature oxidation film that is inferior in electron conductivity, the formulation is closed to the proportioning formulation of $TiO_2$.

With respect to the electrode catalyst layer, for example, iridium oxide (rutile type $IrO_2$) that is most often used for the generation of oxygen, in the X-ray diffraction pattern, a peak in the low angle side is broader than that in the high angle side, and therefore, an explicit lattice deformation is observed. It is considered that this deformation is caused by the generation of oxygen-deficient $IrO_{2-x}$ but not the proportioning formulation of $IrO_2$.

Accordingly, it is estimated that the chemical potential of oxygen becomes closed to the equilibrium at the interface of the two phases of the high-temperature oxidation film and the electrode catalyst layer in the state that oxygen of the surface of the high-temperature oxidation film is diffused into the electrode catalyst layer during the heat treatment of the electrode catalyst layer. Since in metallic platinum, its outermost surface layer is made of platinum oxide, it may be considered that the same phenomenon occurs as in other platinum group metal oxides.

Although the high-temperature oxidation film of the present invention has both minuteness and adhesion on the surface of the valve metal substrate, a high-temperature oxidation film that is inferior in electron conductivity is formed from the substrate itself. In this regard, oxides of tantalum, niobium, etc. or their mixed oxides with oxides of titanium, tin, etc., as described in JP-B-60-21232 and JP-B-60-22074, which have hitherto been used as an interlayer, may be provided on the surface before or after the formation of a high-temperature oxidation film. Besides, the conventionally proposed conductive interlayers can also be used in combination with the high-temperature oxidation film according to the present invention.

The formation of a high-temperature oxidation film is effectively only in a step of forming a platinum group electrode catalyst layer as shown in Example 1 and Comparative Example 2 described later. There is no limitation with respect to the formation of an interlayer other than such high-temperature oxidation layers having low catalytic activity. As shown in Example 2 and Example 3, it is also effective to provide an interlayer simultaneously with or before or after the formation of the high-temperature oxidation film.

The electrolytic electrode according to the present invention is mainly applied to electrodes for generating oxygen to be exposed under severe conditions during the electrolysis. The electrolytic electrode according to the present invention can also be effectively used as electrolytic electrodes for dilute salt water represented by those for hypochlorous acid water having a high rate of occurrence of oxygen generation as a side reaction and for alkaline ionic water/acidic water in which the polarity is reversed and as electrodes for chloride generation having a type of occurrence of corrosion of the electrode substrate depending upon the electrolysis condition.

FIG. 1 is a schematic view showing one embodiment of an electrolytic electrode according to the present invention.

In an electrolytic electrode 1 made of a valve metal such as titanium or an alloy thereof, the surface of which has been roughed, its surface is oxidized by high-temperature heat treatment to form a high-temperature oxidation film 2 made of an oxidation film of the corresponding valve metal oxide. Since this high-temperature oxidation film 2 is integrated with the electrode substrate 1, the high-temperature oxidation film 2 is not peeled away from the electrode substrate 1 and is rich in corrosion resistance, whereby the electrode substrate 1 is surely protected.

An electrode catalyst 3 containing a metal such as iridium and titanium or a metal oxide thereof as a catalyst is coated and formed on the surface of the high-temperature oxidation film 2. When the formation of the electrode catalyst layer 3 is carried out under heating conditions, or the whole of the electrode after forming the electrode catalyst layer 3 is heated, modification occurs at the interface between the high-temperature oxidation film 2 and the electrode catalyst layer 3, thereby imparting electron conductivity to the high-temperature oxidation film 2 that is originally non-electron conductive. Thus, it becomes possible to flow a large amount of current at the industrial electrolysis level.

An oxide-oxide linkage is formed between the high-temperature oxidation film 2 and the electrode catalyst layer 3 composed mainly of an oxide, thereby surely supporting the electrode catalyst layer 3.

First of all, mercury was poured into a nickel-made cylindrical container having an inner diameter of 20 mm and a depth of 20 mm. A metallic titanium rod having a diameter of 3 mm and a length of 100 mm was subjected to high-temperature oxidation treatment at a prescribed temperature for a prescribed period of time, one end of which was then cut to peel away a high-temperature oxidation film so as to make it possible to flow a current. The titanium rod was semi-fixed, and one end where the high-temperature oxidation film remained was immersed in mercury in a length of about 9.9 mm such that the contact area became about 100 $mm^2$ (1 $cm^2$). A prescribed value of a current was flown while setting the titanium rod side as plus and the nickel container side as minus, and a voltage between the titanium rod and the nickel container was measured and reduced into a resistance value. The results (measured values of contact resistance of the high-temperature oxidation film) are shown in Table 1.

In the table, the "$\Omega cm^2$" unit expresses a resistance value $\Omega$ corresponding to the unit area $cm^2$ when a current is flown in the perpendicular direction to the oxidation film. These values are different from a value obtained by measuring the resistance of the oxidation film in the cross section horizontal direction by placing a probe on the surface in the four probe method or the like.

TABLE 1

Measured values of contact resistance of high-temperature oxidation film

| Current value ($A/cm^2$) | Film resistance (in the vertical direction) ($\Omega cm^2$) High-temperature oxidation treatment condition | | | | | |
|---|---|---|---|---|---|---|
| | At 500° C. for one hour | At 500° C. for 3 hours | At 600° C. for one hour | At 600° C. for 3 hours | At 650° C. for one hour | At 650° C. for 3 hours |
| 0.0095 | — | — | — | — | — | 16.419 |
| 0.0165 | — | — | — | — | — | 15.931 |
| 0.0330 | — | — | — | — | — | 14.367 |
| 0.0427 | — | — | — | — | 2.308 | — |
| 0.0495 | — | — | — | — | — | 13.789 |
| 0.0500 | 0.078 | 0.316 | 0.624 | 0.700 | — | — |
| 0.0828 | — | — | — | — | 2.195 | — |
| 0.1000 | 0.063 | 0.316 | 0.620 | 0.670 | — | — |
| 0.1233 | — | — | — | — | 2.181 | — |
| 0.1500 | 0.068 | 0.295 | 0.593 | 0.687 | — | — |
| 0.1562 | — | — | — | — | 2.626 | — |
| 0.2000 | 0.070 | 0.264 | 0.560 | 0.670 | — | — |
| Average | 0.070 | 0.298 | 0.599 | 0.682 | 2.327 | 15.126 |

—: No measured value

When a valve metal is contained in the electrode catalyst layer 3, a firmer linkage is formed between the valve metal in the high-temperature oxidation film 2 and the valve metal in the electrode catalyst layer 3, whereby the durability is sufficiently enhanced.

An example of measuring the contact resistance value of an actual high-temperature oxidation film of metallic titanium will be described below as Referential Example of the present invention.

REFERENTIAL EXAMPLE

To avoid abrasion or dropping of the oxidation film due to strong contact or generation of an error due to partial contact, mercury was used as a contact material.

If a current of 3 $A/cm^2$ as in this Example were flown into the oxidation film layers having an average film resistance of 0.070, 0.298, 0.599, 0.682, 2.327 and 15.126 $\Omega cm^2$ in Table 1, respectively, an increase of voltage of 0.2, 0.9, 1.8, 2.0, 7.0 and 45.5 V should have been originally generated, respectively. However, when each electrode was actually provided for electrolysis after forming an electrode catalyst layer by the thermal decomposition method, all of the electrodes exhibited a standardized cell voltage as high as about 4.5 V, so that there was observed no difference.

Examples and Comparative Examples with respect to the electrolytic electrode according to the present invention along with the process of producing the same will be described below, but it should not be construed that the present invention is limited thereto.

EXAMPLE 1

The surface of each of 15 sheets in total of 3 mm-thick titanium plates for general industrial use was roughed by blasting with #20 alumina particles and then cleaned by dipping in boiling 20% hydrochloric acid to prepare 15 sheets in total of electrode substrates. The substrate was subjected to temperature rising in air at a rate of about 5° C./min from room temperature. The substrate was heat treated at each of the arrival temperatures for a prescribed holding time (see Table 2) and then subjected to furnace cooling to obtain a high-temperature oxidation film of titanium substrate. An increase of weight of the high-temperature oxidation film of each substrate ($g/m^2$ and a value as reduced into $mg/cm^2$) is shown in Table 2 (Examples 1-1 to 1-15).

A 10% hydrochloric acid mixed solution of iridium chloride containing 70 g/l of iridium and tantalum chloride containing 30 g/l of tantalum was coated on each titanium substrate having such a high-temperature oxidation film formed thereon, dried, and then baked in a muffle furnace kept at 500° C. for 10 minutes. This operation was repeated 12 times to prepare an electrode comprising, as an electrode catalyst, a mixed oxide of iridium oxide and tantalum oxide containing about 12 $g/m^2$ of iridium.

Each of the electrodes was tested for electrolytic life in 150 g/l of a sulfuric acid aqueous solution of 60° C. at a current density 3 $A/cm^2$ while using a platinum plate as a cathode. At a point of time when the cell voltage increased by 1 V, the life of electrode was judged.

It was confirmed that all of these electrodes kept stable electrolysis and could be used for 1,300 hours or longer, a value of which is a life of electrolysis test corresponding to exhibition of a sufficient performance in the industrial electrolytic tank wherein oxygen generation is a main reaction.

The formation condition of the high-temperature oxidation film of each electrode and the results of the test for electrolytic life are shown in Table 2.

Figure 2:
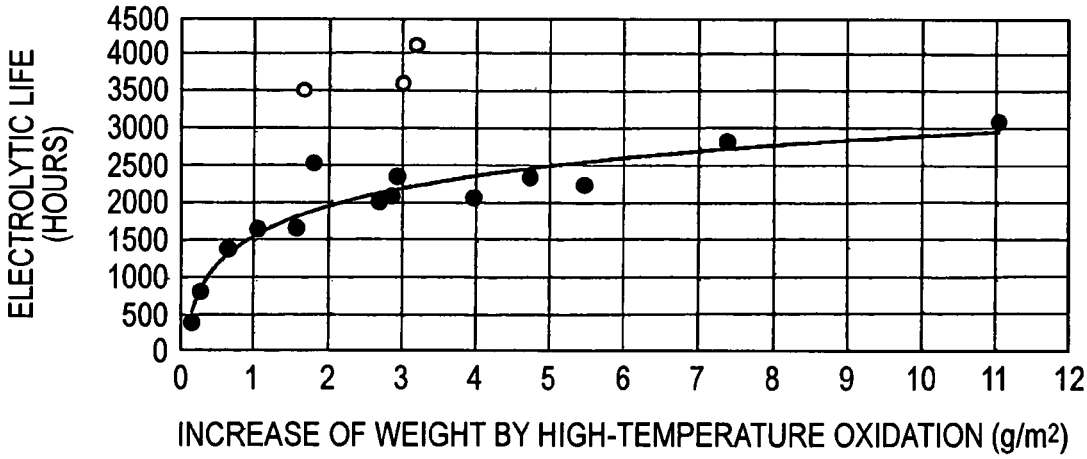
FIG. 2 is a graph showing the relationship between the increase of weight of the high-temperature oxidation film and the electrolytic life obtained in the Examples and Comparative Examples.

Further, the relationship between the increase of weight of the high-temperature oxidation film and the electrolytic life (part of Examples 1-1 to 1-15) is shown in FIG. 2. Incidentally, FIG. 2 also includes the results of Comparative Examples 1-1 and 1-2 in which only the increase of weight by high-temperature oxidation is different.

TABLE 2

Heat treatment condition of electrode and results of test for electrolytic life

| Example and Comparative Example No. | High-temperature oxidation of substrate: Heat treatment: Temperature (° C.) | Time (Hrs.) | Increase of weight ($g/m^2$) | Increase of weight ($mg/cm^2$) | Weight of $TiO_2$ (reduced value) ($g/m^2$) | Thickness of $TiO_2$ (reduced value) (μm) | Baking temperature of electrode catalyst layer (° C.) | Post baking: Temperature (° C.) | Post baking: Time (Hrs.) | Electrolytic life (Hrs.) |
|---|---|---|---|---|---|---|---|---|---|---|
| Example 1-1 | 600 | 1 | 0.67 | 0.067 | 1.67 | 0.39 | 500 | No | | 1385 |
| Example 1-2 | 600 | 3 | 1.06 | 0.106 | 2.65 | 0.62 | | | | 1648 |
| Example 1-3 | 600 | 24 | 3.20 | 0.320 | 7.99 | 1.87 | | | | 4107 |
| Example 1-4 | 650 | ¾ | 1.80 | 0.180 | 4.49 | 1.05 | | | | 2533 |
| Example 1-5 | 650 | ¾ | 1.67 | 0.167 | 4.16 | 0.98 | | | | 3502 |
| Example 1-6 | 650 | 1 | 1.57 | 0.157 | 3.92 | 0.92 | | | | 1662 |
| Example 1-7 | 650 | 3 | 2.87 | 0.287 | 7.16 | 1.68 | | | | 2094 |
| Example 1-8 | 650 | 3 | 2.70 | 0.270 | 6.74 | 1.58 | | | | 2025 |
| Example 1-9 | 650 | 3 | 2.94 | 0.294 | 7.34 | 1.72 | | | | 2352 |
| Example 1-10 | 650 | 4 | 3.02 | 0.302 | 7.54 | 1.77 | | | | 3595 |
| Example 1-11 | 650 | 8 | 3.98 | 0.398 | 9.94 | 2.33 | | | | 2068 |
| Example 1-12 | 650 | 12 | 5.48 | 0.548 | 13.67 | 3.20 | | | | 2239 |
| Example 1-13 | 650 | 16 | 4.74 | 0.474 | 11.83 | 2.77 | | | | 2351 |
| Example 1-14 | 700 | 8 | 7.38 | 0.738 | 18.42 | 4.31 | | | | 2827 |
| Example 1-15 | 750 | 4 | 11.04 | 1.104 | 27.56 | 6.45 | | | | 3086 |
| Comparative Example 1-1 | 500 | 1 | 0.18 | 0.018 | 0.45 | 0.11 | | | | 406 |
| Comparative Example 1-2 | 500 | 3 | 0.30 | 0.030 | 0.75 | 0.18 | | | | 814 |
| Comparative Example 2-1 | | | | None | | | 500 | None | | 329 |
| Comparative Example 2-2 | | | | | | | 550 | | | 281 |
| Comparative Example 2-3 | | | | | | | 600 | | | 197 |
| Comparative Example 2-4 | | | | | | | 650 | | | 161 |
| Comparative Example 2-5 | | | | | | | 500 | 650 | 3 | 77 |

The electrolytic life increased in a logarithmic relationship with the increase of weight other than several points present in a peculiar region of 1.5–3.5 g/m$^2$ in terms of the increase of weight by oxidation (points marked with a circle in FIG. 2). This peculiar region is coincident with a region where the color tone of the surface oxidation film changes from pink to gray, and even when the weight increases to 3.5 g/m$^2$ or more, the color tone does not change. This is considered to be a special phenomenon occurred in a transition region where the optical semiconductor characteristic of the surface oxidation film largely changes, but such is theoretically unclear. The electrode having a high-temperature oxidation film with an increase of weight of 0.5 g/m$^2$ or more exhibited a life longer than the electrode having a high-temperature oxidation film interlayer with an increase of weight of less than 0.5 g/m$^2$.

Figure 3:
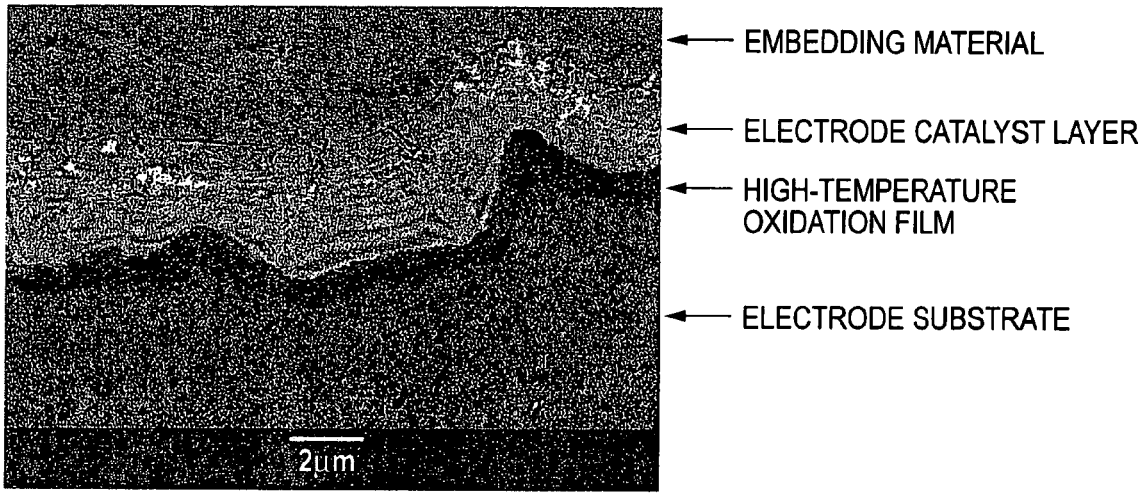
FIG. 3 is a cross section SEM photograph of the electrode sample of Example 1-7 with a magnification of about 5,000 times.

A cross section SEM photograph of the electrode sample of Example 1-7 with a magnification of about 5,000 times is shown in FIG. 3.

COMPARATIVE EXAMPLE 1

Samples were prepared in the same manner as in Example 1, except that the heat treatment was carried out at an arrival temperature of 500° C. for a holding time of one hour (Comparative Example 1-1) and at an arrival temperature of 500° C. for a holding time of 3 hours (Comparative Example 1-2), respectively, followed by performing furnace cooling to obtain high-temperature oxidation films of titanium substrate, and then subjected to test for electrolytic life. The increase of weight was 0.18 g/m$^2$ in Comparative Example 1-1 and 0.30 g/m$^2$ in Comparative Example 1-2, respectively.

In these electrodes, the cell voltage rapidly increased within a short period of time of 406 hours (Comparative Example 1-1) and 814 hours (Comparative Example 1-2), respectively. These results are shown in Table 2.

COMPARATIVE EXAMPLE 2

In providing an electrode catalyst layer on a titanium or titanium alloy substrate by the coating thermal decomposition method, the high-temperature is effective only when it is carried out as the pre-treatment of the substrate. Besides, it is considered that the timing of heat treatment may be during the formation of the electrode catalyst layer or after the formation of the electrode catalyst layer. In this Comparative Example, the role of the high-temperature oxidation step was examined by comparing the usefulness.

An electrode substrate obtained by roughing and cleaning in the same manner as in Example 1 was coated directly with a 10% hydrochloric acid mixed solution of iridium chloride containing 70 g/l of iridium and tantalum chloride containing 30 g/l of tantalum without forming a high-temperature oxidation film, dried, and then baked in a muffle furnace kept at 500° C. (Comparative Example 2-1), 550° C. (Comparative Example 2-2), 600° C. (Comparative Example 2-3) and 650° C. (Comparative Example 2-4), respectively for 10 minutes. This operation was repeated 12 times to prepare an electrode comprising, as an electrode catalyst, a mixed oxide of iridium oxide and tantalum oxide containing about 12 g/m$^2$ of iridium.

Further, one sample was taken from the electrode samples baked at 500° C., heat treated in the same procedures for obtaining a high-temperature oxidation film of titanium substrate by raising the temperature at a rate of about 5° C./min from room temperature and setting up an arrival temperature at 650° C. and a holding time at 3 hours (Comparative Example 2-5), and then subjected to furnace cooling. The heat treatment after the formation of this electrode catalyst layer is hereinafter referred to as "post baking".

Each of the electrodes was tested for electrolytic life in 150 g/l of a sulfuric acid aqueous solution of 60° C. at a current density 3 A/cm$^2$ while using a platinum plate as a cathode. At a point of time when the cell voltage increased by 1 V, the life of electrode was judged.

In all of these electrodes, the cell voltage rapidly increased within an extremely short period of time of 329 hours (Comparative Example 2-1), 281 hours (Comparative Example 2-2), 197 hours (Comparative Example 2-3), 161 hours (Comparative Example 2-4) and 77 hours (Comparative Example 2-5), respectively.

With respect to the fact that the life of the electrode was remarkably inferior as compared with that in Example 1, the following composite two causes may be considered.

From the analysis by X-ray diffraction of the electrode before the electrolysis test, it was noted that when the catalyst layer was formed by baking at 550° C. or higher, in addition to $IrO_2$ having durability as an anode catalyst, metallic Ir that is slightly inferior in durability was formed as a by-product. This means that the electrode catalyst layer was consumed more fast.

Further, from the EPMA analysis of the cross section of the electrode before the electrolysis, it was noted that in all of the electrodes, assuming that the heating was carried out at the same temperature, an abnormal high-temperature oxide layer that is extremely thicker than that of a usual high-temperature oxidation film was formed at the interface in the metallic titanium substrate side to be brought into contact with the electrode catalyst layer. When the electrolysis was carried out, this abnormal high-temperature oxide layer caused remarkable embrittlement or corrosion as compared with the high-temperature oxidation film formed on the titanium substrate in Example 1. In particular, in the case of 600° C. or lower, even elution was observed. It is considered that in baking the electrode catalyst at a usual baking temperature, the high-temperature oxidation film formed in the titanium substrate in Example 1 has an action to suppress the formation of this abnormal high-temperature oxidation layer.

EXAMPLE 2

The surface of each of 8 sheets in total of 3 mm-thick titanium plates for general industrial use was roughed by blasting with #20 alumina particles and then cleaned by dipping in boiling 20% hydrochloric acid to prepare electrode substrates (Examples 2-1 to 2-8).

First of all, prior to forming a high-temperature oxidation film of substrate, each of the six sheets of electrode substrates of Examples 2-1 to 2-6 was coated once with a 10% hydrochloric acid solution of tantalum chloride $TaCl_5$ containing 10 g/l of tantalum as a coating solution for forming a high-temperature oxidation film described in Example 1 of JP-B-60-21232. After drying, the resulting substrate was subjected to temperature rising in air at a rate of about 5° C./min from room temperature, heat treated under a prescribed condition shown in Table 3, and then subjected to furnace cooling, to obtain a high-temperature oxidation film on the titanium substrate.

From the analysis of the X-ray diffraction of this high-temperature oxidation film, in addition to metallic titanium of the substrate, diffraction peaks assigned to $TiO_2$ (rutile type) inevitably formed as its oxide, $Ta_2O_5$ formed from the coating layer, and $Ti_3O$ that is considered to be present at the interface between the high-temperature oxidation film and the substrate were detected.

Separately, prior to forming a high-temperature oxidation film of substrate, each of the two sheets of electrode substrates of Examples 2-7 and 2-8 was coated once with a 10% hydrochloric acid solution of molybdenum chloride $MoCl_5$ containing 10 g/l of molybdenum as a coating solution for forming a high-temperature oxidation film. The resulting substrate was subjected to temperature rising in air at a rate of about 5° C./min from room temperature, heat treated at an arrival temperature of 650° C. for a holding time of 45 minutes or 3 hours, and then subjected to furnace cooling, to obtain a high-temperature oxidation film on the titanium substrate.

From the analysis of the X-ray diffraction of this high-temperature oxidation film, in addition to metallic titanium of the substrate, diffraction peaks assigned to $TiO_2$ (rutile type) inevitably formed as its oxide and $Ti_3O$ that is considered to be present at the interface between the high-temperature oxidation film and the substrate were detected. However, molybdenum oxide was not identified. It is considered that since molybdenum oxide $MoO_3$ has a melting point of 795° C., and its vapor pressure is high at 650° C., it was vaporized in the way of baking. Incidentally, in baking at 500° C. as carried out in Comparative Example 3-2 described later, a distinct diffraction peak assigned to molybdenum oxide $MoO_3$ was observed.

A 10% hydrochloric acid mixed solution of iridium chloride containing 70 g/l of iridium and tantalum chloride containing 30 g/l of tantalum was coated on the titanium substrate having such a high-temperature oxidation film formed thereon, dried, and then baked in a muffle furnace kept at 500° C. for 10 minutes. This operation was repeated 12 times to prepare 8 sheets in total of electrodes each comprising, as an electrode catalyst, a mixed oxide of iridium oxide and tantalum oxide containing about 12 g/m$^2$ of iridium.

Each of the electrodes was tested for electrolytic life in 150 g/l of a sulfuric acid aqueous solution of 60° C. at a current density 3 A/cm$^2$ while using a platinum plate as a cathode. At a point of time when the cell voltage increased by 1 V, the life of electrode was judged. The life of each of the electrodes is shown in Table 3.

It was confirmed that all of these electrodes kept stable electrolysis and could be used for 1,300 hours or longer, a value of which is a life of electrolysis test corresponding to exhibition of a sufficient performance in the industrial electrolytic tank wherein oxygen generation is a main reaction.

Consideration of Examples and Comparative Examples is as follows.

In Examples 2-1 to 2-6 in which after coating tantalum chloride, high-temperature oxidation was carried out, there is seen a tendency that the electrolytic life was prolonged as compared with that of the high-temperature oxidation film prepared by only high-temperature oxidation. These examples are an example in which corrosion resistance of tantalum oxide is added to the high-temperature oxidation film, namely an additive or synergistic effect is observed.

On the other hand, in Examples 2-7 and 2-8 in which after coating molybdenum chloride, high-temperature oxidation was carried out, though a sufficient electrolytic life was obtained, an additive or synergistic effect due to coating of molybdenum chloride was not observed. However, no negative effect was observed.

These conditions and electrolysis results are shown in Table 3.

TABLE 3

Formation condition of high-temperature oxidation film and results of test for electrolytic life

| Example and Comparative Example No. | Heat treatment Temperature (° C.) | Heat treatment Time (Hrs.) | Increase of weight (g/m$^2$) | Increase of weight (mg/cm$^2$) | Weight of $TiO_2$ (reduced value) (g/m$^2$) | Thickness of $TiO_2$ (reduced value) (μm) | Electrolytic life (Hrs.) | Remarks |
|---|---|---|---|---|---|---|---|---|
| Example 2-1 | 650 | ¾ | 1.56 | 0.156 | 3.89 | 0.91 | 4312 | After coating tantalum chloride, high-temperature oxidation was carried out. |
| Example 2-2 | 650 | 3 | 2.61 | 0.261 | 6.51 | 1.52 | 2208 | After coating tantalum chloride, high-temperature oxidation was carried out. |
| Example 2-3 | 650 | 4 | 2.84 | 0.284 | 7.08 | 1.66 | 4287 | After coating tantalum chloride, high-temperature oxidation was carried out. |
| Example 2-4 | 650 | 8 | 3.66 | 0.366 | 9.13 | 2.14 | 2327 | After coating tantalum chloride, high-temperature oxidation was carried out. |
| Example 2-5 | 650 | 16 | 4.18 | 0.418 | 10.44 | 2.44 | 2680 | After coating tantalum chloride, high-temperature oxidation was carried out. |
| Example 2-6 | 700 | 4 | 4.71 | 0.471 | 11.77 | 2.76 | 2444 | After coating tantalum chloride, high-temperature oxidation was carried out. |
| Example 2-7 | 650 | ¾ | 1.40 | 0.140 | 3.51 | 0.82 | 3184 | After coating molybdenum chloride, high-temperature oxidation was carried out. |
| Example 2-8 | 650 | 3 | 2.64 | 0.264 | 6.60 | 1.55 | 2422 | After coating molybdenum chloride, high-temperature oxidation was carried out. |

TABLE 3-continued

Formation condition of high-temperature oxidation film and results of test for electrolytic life

| Example and Comparative Example No. | Heat treatment Temperature (° C.) | Time (Hrs.) | Increase of weight (g/m$^2$) | (mg/cm$^2$) | Weight of $TiO_2$ (reduced value) (g/m$^2$) | Thickness of $TiO_2$ (reduced value) (μm) | Electrolytic life (Hrs.) | Remarks |
|---|---|---|---|---|---|---|---|---|
| Comparative Example 3-1 | 500 | ⅙ | 0.07 | 0.007 | 0.17 | 0.04 | 673 | After coating tantalum chloride, high-temperature oxidation was carried out. |
| Comparative Example 3-2 | 500 | ⅙ | 0.08 | 0.008 | 0.20 | 0.05 | 289 | After coating molybdenum chloride, high-temperature oxidation was carried out. |

Although the resulting tantalum oxide had a net weight of about 0.05 g/m$^2$, the increase of weight after coating of tantalum chloride and subsequent high-temperature oxidation was inversely smaller than the increase of weight of the high-temperature oxidation film of the simple titanium substrate. It is estimated that the oxidation of the titanium substrate was suppressed by the tantalum oxide. With respect to the molybdenum oxide, it is considered that though the molybdenum oxide was vaporized during the high-temperature oxidation at 650° C. or higher, it played the same action during a time when it remained.

COMPARATIVE EXAMPLE 3

Samples were prepared in the same manner as in Example 2, except that after coating the coating solution and drying, the heat treatment was carried out at an arrival temperature of 500° C. for a holding time of 10 minutes, followed by furnace cooling to obtain high-temperature oxidation films of titanium substrate, and then subjected to test for electrolytic life. In Comparative Example 3-1, after coating tantalum chloride, the sample was subjected to heat oxidation, and in Comparative Example 3-2, after coating molybdenum chloride, the sample was subjected to heat oxidation. The increase of weight of the titanium substrate in Comparative Example 3-1 was 0.07 g/m$^2$, and the increase of weight of the titanium substrate in Comparative Example 3-2 was 0.08 g/m$^2$.

In these electrodes, the cell voltage rapidly increased within a short period of time.

These conditions and electrolysis results are shown in Table 3.

EXAMPLE 3

The surface of each of 3 sheets in total of 3 mm-thick titanium plates for general industrial use was roughed by blasting with #20 alumina particles and then cleaned by dipping in boiling 20% hydrochloric acid to prepare 3 sheets in total of electrode substrates.

One of these substrates was injected with a Ta ion at injection energy of 45 keV in an injection amount of $1\times10^{16}$ ions/cm$^2$ (Example 3-1); and another substrate was injected with a Ta ion at injection energy of 45 keV in an injection amount of $1\times10^{17}$ ions/cm$^2$ (Example 3-2). Still another substrate was subjected by composite ion injection of Ta and Ni by injecting first with a Ta ion at injection energy of 45 keV in an injection amount of $1\times10^{17}$ ions/cm$^2$ and then with an Ni ion at injection energy of 50 keV in an injection amount of $5\times10^{16}$ ions/cm$^2$ (Example 3-3).

These samples were subjected to crystal structure analysis using a transmission electron microscope. In the Ta ion-injected substrates, a diffraction ring of the α phase of metallic titanium and a diffraction ring of the β phase caused due to the injection of Ta ion as a β phase stabilizing element were respectively observed. On the other hand, in the substrate injected with a composite ion of Ta and Ni, a diffraction ring of an intermetallic compound $Ti_2Ni$ was observed in addition to the α phase and β phase of metallic titanium. However, metallic nickel and an Ni—Ta intermetallic compound such as $Ni_3Ta$ were not observed. It can be considered that the surface layers of these substrates are made of a Ti—Ta alloy and a Ti—Ta—Ni alloy, respectively.

Further, these three sheets of substrates were subjected to temperature rise in air at a rate of about 5° C./min from room temperature and heated treated at an arrival temperature of 650° C. for a holding time of 3 hours, followed by furnace cooling to obtain high-temperature oxidation films of titanium substrate. The increase of weight of the titanium substrate was 2.79 g/m$^2$ (Example 3-1), 2.36 g/m$^2$ (Example 3-2) and 2.34 g/m$^2$ (Example 3-3), respectively.

These samples were analyzed by X-ray diffraction. From the Ta ion-injected substrates, diffraction peaks assigned to metallic titanium as the substrate, $TiO_2$ (rutile type) inevitably formed as its oxide, $Ta_2O_5$, and $Ti_3O$ that is considered to be present at the interface between the high-temperature oxidation film and the substrate were detected. On the other hand, in the substrate injected with a composition ion of Ta and Ni, a slight peak assigned to $NiTiO_3$ was observed in addition to these diffraction peaks.

A10% hydrochloric acid mixed solution of iridium chloride containing 70 g/l of iridium and tantalum chloride containing 30 g/l of tantalum was coated on the titanium substrate having such a high-temperature oxidation film formed thereon, dried, and then baked in a muffle furnace kept at 500° C. for 10 minutes. This operation was repeated 12 times to prepare electrodes each comprising, as an electrode catalyst, a mixed oxide of iridium oxide and tantalum oxide containing about 12 g/m$^2$ of iridium.

Each of the electrodes was tested for electrolytic life in 150 g/l of a sulfuric acid aqueous solution of 60° C. at a current density 3 A/cm$^2$ while using a platinum plate as a cathode. At a point of time when the cell voltage increased by 1 V, the life of electrode was judged.

It was confirmed that all of these electrodes kept stable electrolysis and could be used for 1,300 hours or longer, a value of which is a life of electrolysis test corresponding to exhibition of a sufficient performance in the industrial electrolytic tank wherein oxygen generation is a main reaction.

When the metallic titanium substrate, the vicinity of the surface of which had been alloyed by ion injection, was subjected to high-temperature oxidation treatment as a post treatment, a variety of influences were given to the electrolytic life depending upon the kind and amount of an element to be injected.

For example, in the case of the injection with a Ta ion, as shown in Example 3-1 and Comparative Example 4-1 in which the amount of the Ta ion is low, the high-temperature oxidation treatment was very largely effective. On the other hand, as shown in Example 3-2 and Comparative Example 4-2, when the amount of the Ta ion is high, and a sufficient electrolytic life could be originally obtained even by not subjecting to high-temperature oxidation, its effect was limitative or additive.

On the other hand, in the case of the injection of a composite ion of Ta and Ni, $Ti_2Ni$ that is inferior in resistance to electrolysis in the anode was present from the initial stage and was converted into $NiTiO_3$ that is also inferior in corrosion resistance by high-temperature oxidation, leading to a large expansion of the life by the high-temperature treatment. It is considered that $NiTiO_3$ that is present in the fine granular state is included in the high-temperature oxidation film and isolated, whereby adverse influences are suppressed. That is one of the effects of the high-temperature oxidation film.

These conditions and electrolysis results are shown in Table 4.

high-temperature oxidation treatment such that an increase of weight is 0.5 $g/m^2$ or more, and preferably 0.67 $g/m^2$ or more, and an electrode catalyst layer formed on the surface of the high-temperature oxidation film and to a process of producing the same.

By heat treating a valve metal valve metal alloy electrode substrate in an oxidative atmosphere to form a high-temperature oxidation film having an increase of weight of 0.5 $g/m^2$ or more, or 1.25 $g/m^2$ or more as reduced into $TiO_2$, which is inferior in electron conductivity, and further baking an electrode catalyst layer on the high-temperature oxidation film by the coating thermal decomposition method, the electron conductivity can be consequently increased to obtain an electrolytic electrode capable of flowing a large amount of current at the industrial level.

This high-temperature oxidation film is rich in corrosion resistance, is minute and is firmly welded to the electrode substrate. Accordingly, the high-temperature oxidation film can protect the electrode substrate from a corrosive electrolyte and electrolytic reaction and surely support an electrode catalyst by means of oxide-oxide welding. Thus, the electrode catalyst in the catalyst layer can be effectively applied.

It should further be apparent to those skilled in the art that various changes in form and detail of the invention as shown and described above may be made. It is intended that such changes be included within the spirit and scope of the claims appended hereto.

TABLE 4

Formation conditions of high-temperature oxidation film (interlayer) and results of test for electrolytic life

| Example and Comparative Example No. | Condition of ion injection: Element to be injected | Injection amount (ions/$cm^2$) | Injection energy (keV) | High-temperature oxidation of substrate (post treatment): Temperature (° C.) | Time (Hrs.) | Increase of weight by oxidation ($g/m^2$) | Increase of weight by oxidation ($mg/cm^2$) | Weight of $TiO_2$ (reduced value) ($g/m^2$) | Thickness of $TiO_2$ (reduced value) (μm) | Electrolytic life (Hrs.) |
|---|---|---|---|---|---|---|---|---|---|---|
| Example 3-1 | Ta | $1 \times 10^{16}$ | 45 | 650 | 3 | 2.79 | 0.279 | 6.98 | 1.63 | 3192 |
| Example 3-2 | Ta | $1 \times 10^{17}$ | 45 | 650 | 3 | 2.36 | 0.236 | 5.89 | 1.38 | 2963 |
| Example 3-3 | Ta | $1 \times 10^{17}$ | 45 | 650 | 3 | 2.34 | 0.234 | 5.85 | 1.37 | 1635 |
| | Ni | $5 \times 10^{16}$ | 50 | | | | | | | |
| Comparative Example 4-1 | Ta | $1 \times 10^{16}$ | 45 | | | | None | | | 594 |
| Comparative Example 4-2 | Ta | $1 \times 10^{17}$ | 45 | | | | | | | 2602 |
| Comparative Example 4-3 | Ta<br>Ni | $1 \times 10^{17}$<br>$5 \times 10^{16}$ | 45<br>50 | | | | | | | 208 |

COMPARATIVE EXAMPLE 4

Samples were prepared in the same manners as in Examples 3-1 to 3-3, except that the substrates after the ion injection of Examples 3-1 to 3-3 were each coated with an electrode catalyst as it was without carrying out high-temperature oxidation as the post treatment, and then subjected to test for electrolytic life (Comparative Examples 4-1, 4-2 and 4-3 in order).

In these electrodes other than that of Comparative Example 4-2, the cell voltage rapidly increased within a short period of time.

These conditions and electrolysis results are shown in Table 4.

The present invention relates to an electrolytic electrode comprising a valve metal or valve metal alloy electrode substrate, a high-temperature oxidation film formed on the surface of the valve metal or valve metal alloy electrode by This application is based on Japanese Patent Application No. 2003-136832 filed May 15, 2002, the disclosure of which is incorporated herein by reference in its entirety.

What is claimed is:

1. An electrolytic electrode comprising:

a valve metal or valve metal alloy electrode substrate, a high-temperature oxidation film having a rutile structure formed from the substrate itself on the surface of the valve metal or valve metal alloy electrode by high-temperature oxidation treatment such that an increase of weight is 0.67 $g/m^2$ to 17 $g/m^2$, the high-temperature oxidation film and underlying substrate assuming an oxygen concentration gradient in a depth direction, and an electrode catalyst layer formed on the surface of the high-temperature oxidation film.

2. The electrolytic electrode as claimed in claim 1, wherein the increase of weight is 0.67 $g/m^2$ or more.

3. The electrolytic electrode as claimed in claim 1, wherein within the structure having an oxygen concentration gradient, the oxygen concentration is highest in an outermost surface layer portion of the high-temperature oxidation film.

4. The electrolytic electrode as claimed in claim 1, wherein the high-temperature oxidation film is formed by heating at a temperature of at least 600° C. in an oxidizing atmosphere.

5. The electrolytic electrode as claimed in claim 1, wherein the valve metal comprises Ti and the high-temperature oxidation film comprises $TiO_2$ having a rutile structure.

6. A process of producing an electrolytic electrode comprising:

forming a high-temperature oxidation film having a rutile structure on the surface of a valve metal or valve metal alloy substrate, said high-temperature oxidation film being formed by high-temperature oxidation treatment and from the substrate itself such that its increase of weight is 0.67 $g/m^2$ to 17 $g/m^2$, the high-temperature oxidation film and underlying substrate assuming an oxygen concentration gradient in a depth direction, and forming an electrode catalyst layer on the high-temperature oxidation film.

7. The process as claimed in claim 6, wherein in providing an electrode catalyst layer on the high-temperature oxidation film, the electrode catalyst layer is formed by the coating thermal decomposition method.

8. The process as claimed in claim 6, wherein within the structure having an oxygen concentration gradient, the oxygen concentration is highest in an outermost surface layer portion of the high-temperature oxidation film.

9. The process as claimed in claim 6, wherein the valve metal comprises Ti and the high-temperature oxidation film comprises $TiO_2$ having a rutile structure.

10. A process of producing an electrolytic electrode comprising:

forming a high-temperature oxidation film on the surface of a valve metal or valve metal alloy electrode by high-temperature oxidation treatment, and forming an electrode catalyst layer on the high-temperature oxidation film, wherein in forming the high-temperature oxidation film, an increase of weight of the high-temperature oxidation film is at least an increase of weight of a high-temperature oxidation film of a valve metal or valve metal alloy electrode substrate formed at a heating temperature of 600° C. for a holding time of one hour in air.

11. The process as claimed in claim 10, wherein in providing an electrode catalyst layer on the high-temperature oxidation film, the electrode catalyst layer is formed by the coating thermal decomposition method.

* * * * *